United States Patent [19]

Samuels et al.

[11] Patent Number: 5,065,173

[45] Date of Patent: Nov. 12, 1991

[54] PROCESSOR WITH SPEED INDEPENDENT FIXED FILM SPACING

[75] Inventors: James T. Samuels; Roger D. Ellsworth, both of Rochester, N.Y.

[73] Assignee: Eastman Kodak Company, Rochester, N.Y.

[21] Appl. No.: 495,867

[22] Filed: Mar. 19, 1990

Related U.S. Application Data

[63] Continuation-in-part of Ser. No. 494,647, Mar. 16, 1990, Pat. No. 4,994,837.

[51] Int. Cl.[5] ..... G03D 3/08

[52] U.S. Cl. ..... 354/298; 354/322

[58] Field of Search ..... 354/298, 319, 320, 321, 354/322

[56] References Cited

U.S. PATENT DOCUMENTS 4,057,817 11/1987 Korb et al. ..... 354/298

4,300,828 11/1981 Kaufman ..... 354/322

*Primary Examiner*—A. A. Mathews

*Attorney, Agent, or Firm*—G. Herman Childress

[57] ABSTRACT

An automatic film processor sets new reference developer chemical temperatures and film transport speeds in accordance with user input at a keypad and establishes a new delay time to provide constant fixed spacing along the transport path between trailing edge of one film sheet and leadfing edge of a next film sheet regardless of transport speed. "Wait" and "ready" lights are controlled to signal when a next sheet is to be fed. A microcomputer calculates the delay time and loads a counter. A buzzer signals countdown to zero.

14 Claims, 3 Drawing Sheets

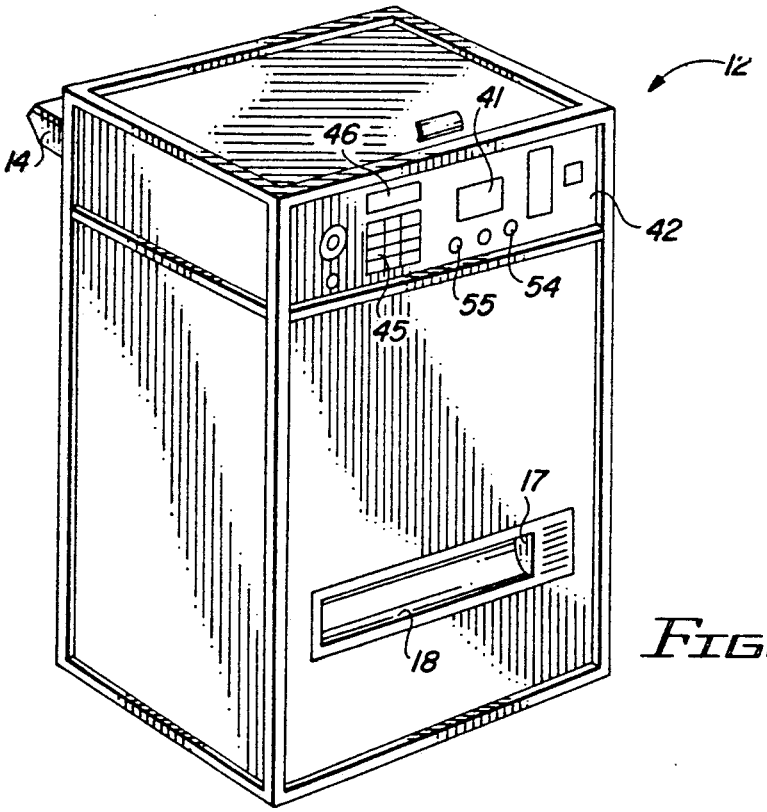
FIG. 1
FIG. 2
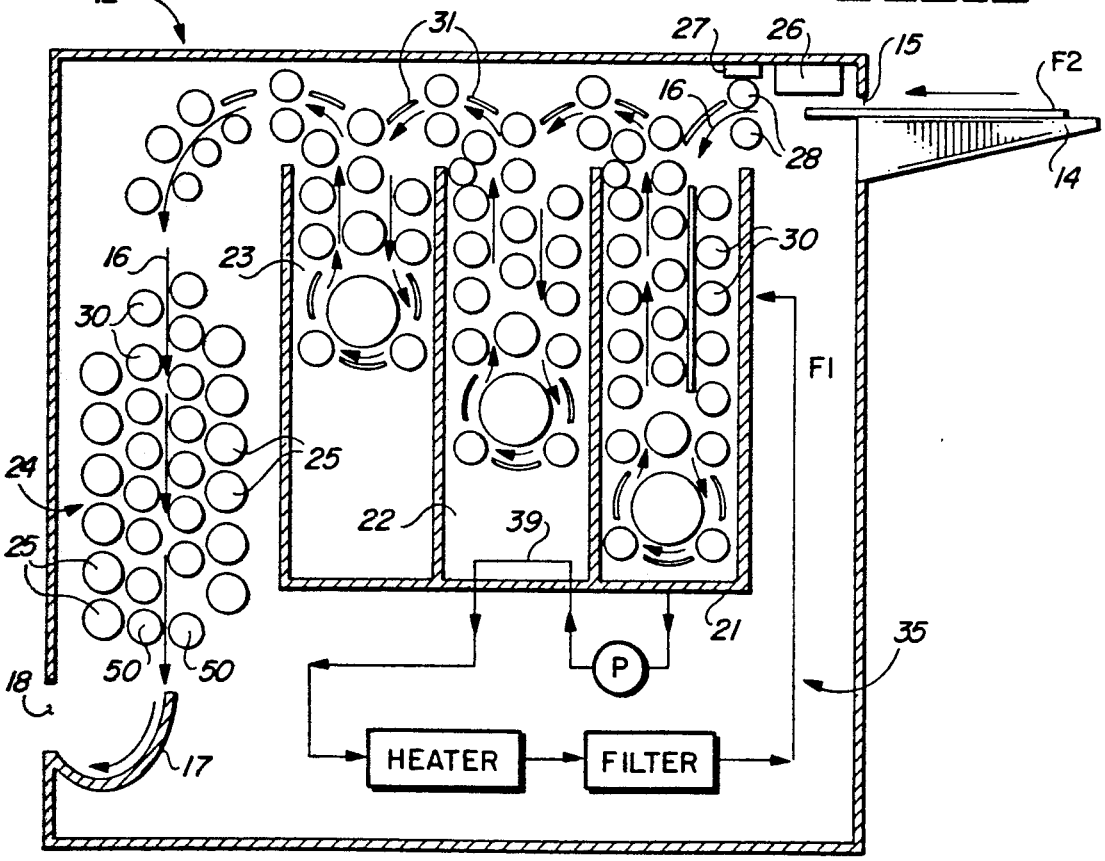

PROCESSOR WITH SPEED INDEPENDENT FIXED FILM SPACING

This is a continuation-in-part of commonly owned, copending U.S Pat. application Ser. No. 07/494,647, filed Mar. 16, 1990, now U.S. Pat. No. 4,994,837, entitled "Processor With Temperature Responsive Film Transport Lockout."

BACKGROUND OF THE INVENTION

The present invention relates to processors of film and similar photosensitive media, in general; and, in particular, to a processor having means to vary transport speed and including means to maintain fixed interfilm spacing regardless of transport speed.

Photosensitive media processors, such as the Kodak X-OMAT processors, are useful in applications such as the automatic processing of radiographic films for medical imaging purposes. The processors automatically transport sheets or webs of photosensitive film, paper or the like (hereafter "film") from a feed end of a film transport path, through a sequence of chemical processing tanks in which the media is developed, fixed, and washed, and then through a dryer to a discharge or receiving end. The processor typically has a fixed film path length, so final image quality depends on factors including transport speed which determines length of time the film strip is in solution, and the temperature and composition of the processing chemicals (the processor "chemistry").

In a typical automatic processor of the type to which the invention relates, film transport speed is set at a constant rate and the chemistry is defined according to a preset recommended temperature, e.g. 93° F., with a specified tolerance range of +/−X° F. A temperature control system is provided in the processor to keep the chemicals within the specified range.

Conventional processors usually include a film width sensor in the form of a reflective infrared sensor array adjacent a feed entrance opening, and may also include a feed detector in the form of a Hall effect switch or the like for detecting separation of entrance rollers due to the passage of film sheets at the front end of the transportation path. The film width sensor not only provides an indication of the width of a sheet entering the processor, but may also provide an indication of the occurrence of the leading edge and trailing edge of each sheet, since the signals from the film width sensor will change significantly as each leading and trailing edge is encountered. Information as to leading and trailing edge occurrences and width of the film, taken with prior knowledge of the constant transport speed, is used to keep track of cumulative total film surface area processed in order to guide chemistry replenishment control. The use of a separate entrance roller detector signals that a sheet of film has actually entered the nip of the first roller pair, and is not just sitting still on the film guide under the width sensor.

When sheets of film are sequentially fed into a processor, it is desirable that a spacing be maintained between the trailing edge of a first sheet and a leading edge of a next one in order to avoid overlap. The spacing should be enough so that overlap is avoided even though one or both of the sheets suffer some slippage and/or skewing along the transport path, but not so great that processing time is unduly affected. For a particular constant fixed transport speed processor, proper film spacing may be controlled by a fixed set time interval between the entry into the processor of the trailing edge of the first sheet and the time when the user is signalled to enter the next sheet. When the entry of the leading edge of the first sheet into the processor is detected, an annunciator in the form of a "wait" light is illuminated to signal that the required spacing has not yet been attained. At a set time after the entrance of the trailing edge into the processor has been detected, the "wait" light is extinguished and a "ready" light is illuminated.

Although conventional processors used for radiographic image processing are traditionally configured to operate at a constant film transport speed, modifications may be made through gear changes and the like to vary the process. Moreover, new processors are being introduced which are usable in more than one mode. The mode is often referred to in shorthand fashion by a nominal film transport "drop time", which may be defined as the time from entry of the leading edge of a sheet of film at the feed end until exit of the trailing edge of the same sheet of film at the discharge end. Conventional processors operate in standard (90 second), rapid (45 second), or "Kwik" (30 second) mode, and can be varied to operate in an extended-cycle mode, such as described in L. Taber & A. G. Hans, "Processing of Mammographic Films: Technical and Clinical Consideration," *Radiology*, Vol. 173, No. 1, pages 65–69, Oct. 1989. In the latter mode, processor speed is lowered and chemistry temperature is raised to enhance image contrast for better detection of changes in density of fibrous tissue. The new processors will be settable as to run parameters, including transport speed in order to be able to use the same processor for multiple processing modes.

It is desirable, in a processor having selectable transport speed, to be able to maintain a fixed interfilm spacing during transport regardless of the transport speed setting. Conventional systems that operate on a fixed time interval to determine film spacing are inadequate for this purpose. When faster transport speeds are selected, the same fixed time interval will give a spacing that is too great. When slower transport speeds are selected, the same interval will give a spacing that is too small.

One prior art arrangement, described in U.S. Pat. No. 4,300,828, sets spacing using a feed counter clocked by a drive shaft encoder. A microcomputer loads the feed counter with a number corresponding to the number of shaft encoder pulses needed to drive the trailing edge of the sheet past a particular point of the transport path. When the count reaches zero, a feed annunciator is actuated and a "wait" light is turned off. There is no teaching or recognition in the '828 patent of using such a shaft encoder system in a processor whose transport speed is settable. Moreover, the mechanical nature of the encoder limits programming flexibility.

SUMMARY OF THE INVENTION

It is an object of the present invention, in a processor utilizing a fixed time period between trailing edge of a first sheet and leading edge of a second sheet, to provide a system for varying the fixed time in response to variation in transport speed, so as to maintain a fixed interfilm spacing to avoid overlap regardless of film transport speed.

It is another object of the present invention to provide an annunciator to signal the attainment of recommended film sheet spacing in an automatic processor configured to operate at a plurality of film transport speed settings.

In accordance with the invention, a processor of exposed photosensitive media having means for automatically transporting film along a path through developer, fixer, wash and dryer stations and means for monitoring the entrance of a trailing edge of a particular medium into the processor, further comprises means responsive to user input for setting system parameters including a desirable transport speed, and means for determining and signalling the passage from entrance of that trailing edge to the time to feed the next medium at a desired fixed optimum spacing.

In one aspect of the invention, described in greater detail below, processor film transport speed is set according to user selection of a processor operating mode, and annunciators in the form of "ready" and "wait" lights are controlled in accordance with a determination of lead time needed to assure maintenance of a desired linear spacing between successive sheets of film, for the particular processor mode setting. A microcomputer determines the number of clock counts to be loaded into a counter responsive to setting of the transport speed.

BRIEF DESCRIPTION OF THE DRAWINGS

Embodiments of the invention have been chosen for purposes of illustration and description and are shown in the accompanying drawings, wherein:

FIG. 1 is a perspective view of a processor in which a fixed film spacing system in accordance with the present invention can be employed;

FIG. 2 is a schematic representation of relevant elements of the processor of FIG. 1;

Throughout the drawings, like elements are referred to by like numerals.

DETAILED DESCRIPTION OF THE PREFERRED EMBODIMENTS

Figure 3:
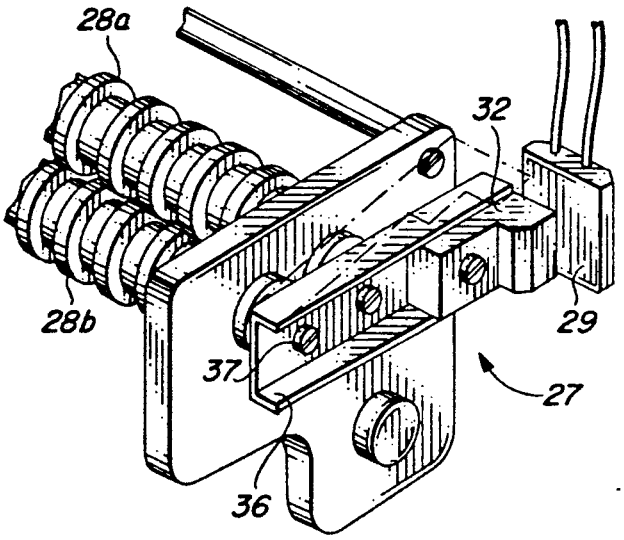
FIG. 3 is a fragmentary view of an entrance roller detector usable in the processor of FIGS. 1 and 2.

The principles of the invention are illustrated, by way of example, embodied in the form of a fixed film spacing system 10 (FIG. 4) suitable for use with a processor 12 (FIGS. 1 and 2) for the automatic processing of photosensitive media in the form of successive sheets of film F1, F2 (FIG. 2), such as for the development of radiographic images for medical diagnostic purposes.

The processor 12 has a feed shelf 14 positioned ahead of an entrance opening 15 (FIG. 2). The front end of the processor 12 including feed shelf 14 and entrance opening 15 is located in a darkroom to avoid unwanted exposure of the sheets F1, F2 fed into the processor 12. The remaining portion of the processor 12 may be outside the darkroom. Sheets Fl, F2 entered through entrance opening 15 are transported through the processor 12 along a travel path 16 (indicated by arrows), and are eventually driven out of the back end of processor 12 into a catch bin 17 at an exit opening 18.

The processor 12 includes a developing station comprising a tank 21 filled with developer chemical; a fixing station comprising a tank 22 filled with fixer chemical; and a wash station comprising a tank 23 filled with wash water or comprising some other appropriate film washing device. Processor 12 also includes a drying station 24 comprising oppositely-disposed pluralities of air dispensing tubes 25 or some other appropriate film drying mechanism.

Positioned proximate opening 15 is a sensor 26, such as a conventional universal film detector board, reflective infrared sensor array which provides signals indicative of sheet width when a sheet F1, F2 is presented at the entrance opening 15. The film width sensor 26 also provides an indication of the occurrence of passage of the leading edge and trailing edge of each sheet past point 26 of the processor 12. A second sensor 27, in the form of a magnetic reed switch 29 or the like (FIG. 3), may be provided to detect separation of entrance rollers 28 to signal the beginning of transportation of a sheet of film along the path 16. Sensor 27, as shown, is a Hall effect sensor and has an actuator or slug 32 mounted on a rocker arm 36 for movement about a pivot pin 37, from the solid line to the dot-dashed line position, in response to separation of the upper entrance roller 28*a* from the lower entrance roller 28*b*. Other sensors may also be used.

In FIG. 2, the sheet path 16 is shown as defined by a plurality of film transport rollers 30 and a plurality of guide shoes 31 located to direct a sheet of film F sequentially through the tanks 21, 22, 23 and dryer 24. The rollers 30 form the transport system for transporting the sheets F1, F2 through the processor 12. Crossover assemblies act at the interfaces between the respective tanks 21, 22, 23 and dryer 24 to transport sheets between the corresponding stations. Rollers 30 may be driven in conventional manner by a common drive shaft 33 (FIG. 4) having alternating right-hand and left-hand axially-spaced worms for driving adjacent columns of rollers 30 at the same speed in counterrotation, so as to move the sheets F1, F2 in the direction of the arrows along path 16. Drive shaft 33 may be connected by a no slip chain drive and toothed sprockets (not shown) to be driven by an electric motor 34 such as, for example, a variable speed brushless DC motor.

The temperature of developer chemical in tank 21 may be controlled by means of a recirculation plumbing path 35 (FIG. 2) having a pump P for drawing developer out of tank 21, through a thermowell or other suitable heater and filter, and then passing it back to the tank 21. A temperature sensor 37 (FIG. 4) is provided in the tank 21 or recirculation path 35 to monitor the temperature of the developer. Developer temperature may be displayed on a meter 41 located on an exterior control panel 42 of the processor 12. Temperature control of fixer chemistry may be conveniently provided by passing an immersed loop 39 through the fixer tank 22.

Figure 4:
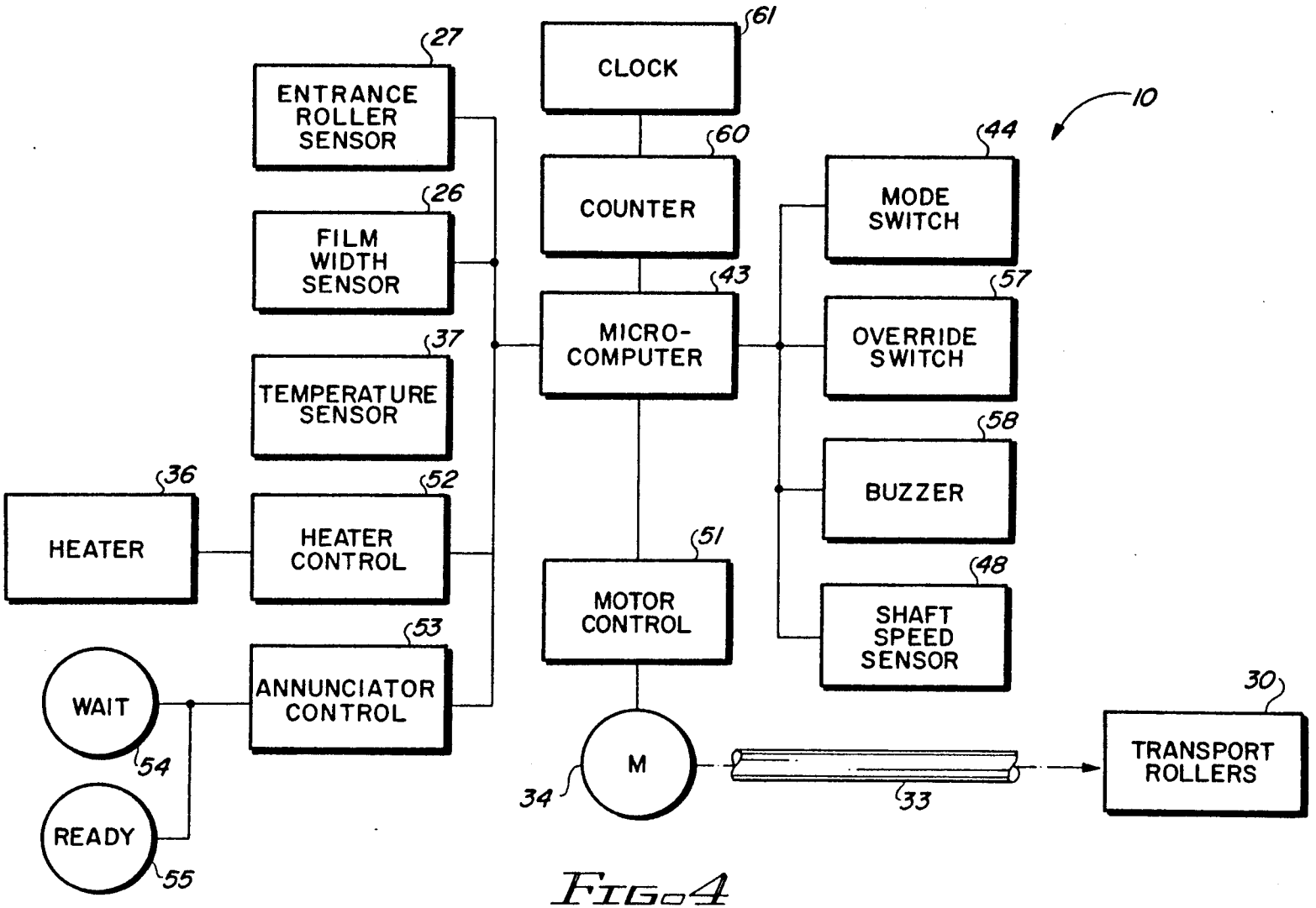
FIG. 4 is a block diagram of the fixed film spacing system employed in the processor of FIGS. 1 and 2.

FIG. 4 illustrates a control system usable in implementing an embodiment of the present invention. As shown in FIG. 4, a microcomputer 43 is connected to direct the operation of the processor 12. Microcomputer 43 receives manual input from the user through a mode switch 44 as to what processor mode of operation is desired. The system can be configured to enable the user to select among predesignated modes, such as standard, rapid, "Kwik," or extended modes having predetermined associated film path speed and chemistry temperature parameters; and can also be configured to permit a user to set a desired path speed and temperature directly. One way to implement mode switch 44 is by means of an alphanumeric keypad 45 and keypad display 46 (FIG. 1) for providing programming communication between the user and the microcomputer 43. For example, a function code can be entered to signal that mode selection is being made, followed by a selection code to designate the selected mode. Alternatively, a function code can be entered for film path speed or chemistry temperature, followed by entry of a selected speed or temperature setting. Another way to implement switch 44 is by means of a plurality of push button or toggle switches, respectively dedicated one for each selectable mode, and which are selectively actuated by the user in accordance with user needs.

Microcomputer 43 is also connected to receive input information from the film width sensor 26, the entrance roller sensor 27, the developer temperature sensor 37 and, optionally, from a shaft speed sensor 48. Shaft speed sensor 48, which may comprise a shaft encoder mounted for rotation with drive shaft 33 and an associated encoder sensor, provides feedback information about the speed of the common shaft 33 that uniformly drives the transport rollers 30 (FIG. 2). This gives the speed with which film is driven along the film transport path 16. The width sensor 26 provides the microcomputer 43 with information on the leading and trailing edge occurrences and the width of the film sheets F1, F2. This can be used together with microprocessor set film speed or film speed measured by sensor 48 to give a cumulative film development area total to control chemistry replenishment. The entrance roller sensor 27 signals when a film sheet leading edge has been picked up by the roller path 16, or when a trailing edge has passed a certain point in path 16. This information can be used together with transport speed and known length of the path 16 from entrance rollers 28 to exit rollers 50 (FIG. 2), to indicate when a sheet of film is present along the path 16.

Microcomputer 43 is shown in FIG. 4 connected to motor control circuitry 51, heater control circuitry 52, and annunciator control circuitry 53. Motor control circuitry 51 is connected to motor 34 to control the speed of rotation of drive shaft 33. This controls the speed of travel of film sheets F1, F2 along the film path 16 and, thus, determines the length of time a sheet spends at each of the stations (viz. controls development time). Heater control circuitry 52 is connected to control the temperature of the developer flowing in the recirculation path 35 (FIG. 2) and, thus, the temperature of developer in tank 21 and fixer in tank 22. Annunciator control circuitry 53 is connected to annunciators in the form of "Wait" light 54 and "Ready" light 55 to control the on/off cycles of the same. Identical "Wait" and "Ready" lights 54, 55 (for example, LED's) may be provided on both the darkroom (not shown) and lightroom (see control panel 42 in FIG. 1) sides of the processor 12.

Figure 5:
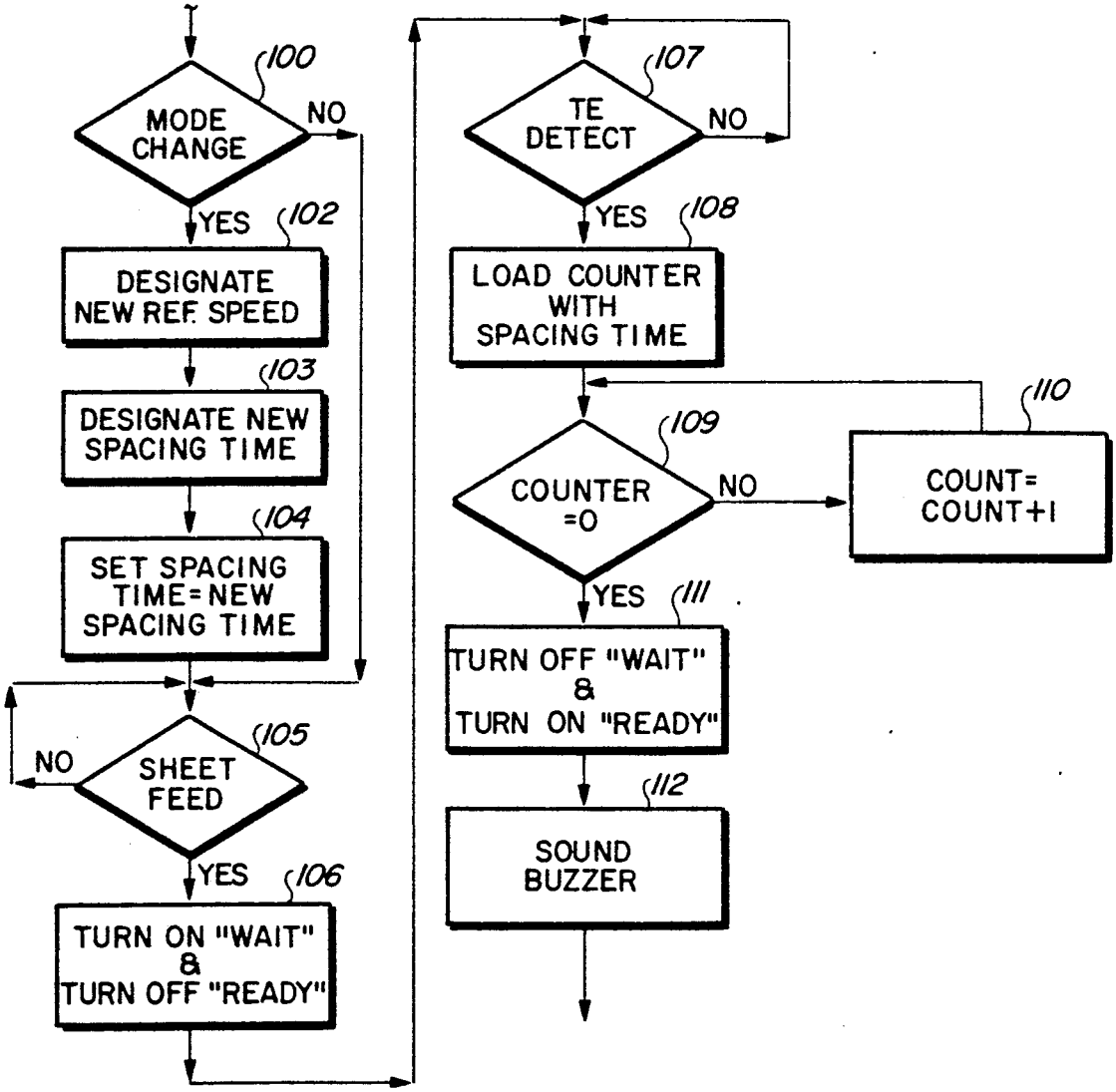
FIG. 5 is a flow diagram of the operation of the system of FIG. 4.

In accordance with the invention, as indicated in the flow diagram of FIG. 5, a user-designated mode change selected at keypad 45 (FIG. 1) or other mode switch 44 (FIG. 4) is input to microcomputer 43 (100) to cause a designation (through look-up table, algorithm or the like) of reference developer temperature and transport speed parameters recommended for the selected mode (102). Motor and heater control circuits 51, 52 are then directed to control the motor and heater to bring the actual developer temperature and film path transport speed into line with the designated reference temperature and speed. The system can be configured, if desired, to permit the entry of a particular film transport speed directly. Selection of a new film transport speed, whether by mode designation or direct entry, will cause a designation of a new time delay period between trailing edge of a first sheet F1 and leading edge of a second sheet F2, needed to achieve a predetermined desired fixed spacing (103, 104).

The time in seconds required between the trailing edge of a first sheet F1 and the leading edge of a second sheet F2 may, for example, be determined using the following algorithm:

$$\text{Time (secs)} = ((L/V) \times 60 \text{ secs/min})/100$$

where L=interfilm spacing in inches×100; and V=film velocity in inches/minute.

Using a desired linear sheet spacing of three inches, the delay time desired to maintain a constant linear separation between sheets F1, F2 along path 16 for different given transport speeds is as follows:

| V (in/min) | time (secs) |
|---|---|
| 30 | 6 |
| 40 | 4.5 |
| 50 | 3.6 |
| 60 | 3 |
| 70 | 2.57 |
| 80 | 2.25 |
| 90 | 2.0 |
| 100 | 1.8 |
| 110 | 1.63 |
| 120 | 1.5 |

The delay times can also be set using a preestablished look-up table.

When the sensors 26 and/or 27 detect the passage of the leading edge of a first sheet F1 into the processor 12 (105), annunciator control circuit 53 is directed by microcomputer 43 to turn the "wait" light 54 on, and the "ready" light 55 off (106). When the trailing edge of sheet F1 is detected (107), microcomputer 43 directs the loading of a counter 60 (FIG. 4) with a number corresponding to the number of pulses of a system clock 61 needed to give the required sheet separation time in seconds determined in response to the selection of transport speed (108). When the count in counter 60 reaches zero (109, 110), the "wait" light is turned off and the "ready" light turned on (111). This indicates to the user that the sheet F1 has passed a point where the next sheet F2 can be fed into the processor.

As shown in FIG. 5, if counter 60 is not at zero, the "wait" light 54 remains on and the "ready" light 55 remains off (109). When the counter 60 reaches zero, the "wait" light 54 is then switched off and the "ready" light 55 is switched on (111).

Other annunciators, such as a buzzer 58, can be connected to the microcomputer 43 to be actuated whenever counter 60 reaches zero to indicate a "ready" condition exists and a fresh sheet F2 can be fed in at entrance 15 (112).

Those skilled in the art to which the invention relates will appreciate that other substitutions and modifications can be made to the described embodiments without departing from the spirit and scope of the invention as described by the claims below.

What is claimed is:

1. In apparatus for the processing of exposed photosensitive media, said apparatus having means for automatically transporting said media from a feed point along a path through developer, fixer, wash and dryer stations in accordance with a set transport speed, means for monitoring the passage of a trailing edge of a particular medium past said feed point, and annunciator means for signalling a "ready" status for indicating when a next medium can be fed from said feed point along said path, after the trailing edge has advanced a fixed distance along said path, the improvement comprising:

said apparatus further including a timer comprising a system clock for generating pulses at constant time unit intervals independent of said means for transporting, and a counter connected to said clock for counting said pulses; a control panel; means responsive to user input at said control panel for selectively resetting said transport speed to a different transport speed; means, responsive to said selectively resetting means and said monitoring means, for automatically setting a number of said pulses to be counted by said counter, said number corresponding to the time in seconds needed for said trailing edge to advance by said fixed distance along said path at said different transport speed; and means, responsive to counting of said number of pulses by said counter, for controlling said annunciator means to signal the "ready" status when said trailing edge has advanced by said fixed distance along said path.

2. The improvement as in claim 1, wherein said means for transporting comprises a plurality of transport rollers, a motor for driving said rollers, and a microprocessor circuit connected to said motor, said timer and said selectively resetting means for controlling said motor and said timer in accordance with said selectively reset transport speed.

3. The improvement as in claim 2, wherein said annunciator means comprises at least one light.

4. The improvement as in claim 2, wherein said apparatus is configured to operate at a specified one of a plurality of predefined transport speeds corresponding respectively to a plurality of operating modes, said means for resetting comprises means for selecting one of said modes and programming said microprocessor circuit according to the selected mode to control said timer and said motor in accordance with said one of said transport speeds corresponding to said selected mode.

5. The improvement as in claim 4, wherein said means for selecting one of said modes comprises a mode switch and means for enabling user manual input to said mode switch.

6. The improvement as in claim 5, wherein said means for enabling user input comprises a user operable keypad.

7. Apparatus for the processing of exposed photosensitive media, comprising:

a developer tank for the containment of developer;

user input means for selecting one of a plurality of operating modes;

means for automatically defining a transport speed in response to said selected operating mode;

means for automatically transporting successive sheets of said media from a feed point along a path through said developer tank in accordance with said defined transport speed;

means for sensing the passage of a trailing edge of a first of said sheets past said feed point;

a timer comprises a system clock for generating pulses at constant time unit intervals independent of said means for transporting, and a counter connected to said clock for counting said pulses;

an annunciator connected to said counter; and means, responsive to said defined transport speed and said sensing means, for automatically setting a number of said pulses to be counted by said counter, said number corresponding to the time in seconds needed for said first sheet to travel a predetermined fixed distance along said path from said feed point at said defined transport speed; and means, responsive to counting of said number of pulses by said counter for controlling said annunciator to signal when said first sheet has travelled said predetermined fixed distance.

8. A method for automatically establishing a fixed minimum spacing between sheets of exposed photosensitive media transported along a path through developer, fixer, wash and dryer stations of a processor having means, including a motor, for automatically transporting successive ones of said sheets from a feed point along said path in accordance with a defined transport speed; means for sensing the passage of an edge of a first sheet past said feed point; a timer including a system clock for generating pulses at constant time unit intervals independent of said means for transporting, and a counter connected to said clock; and an annunciator connected to said timer; comprising the steps of:

defining a transport speed in response to user selection of one of a plurality of operating modes;

controlling said motor in accordance with said defined transport speed;

detecting passage of said edge of said first sheet past said feed point with said sensing means;

in response to detection of said edge of said first sheet, setting a number of pulses to be counted by said counter, said number corresponding to the time in seconds required for said edge traveling at said defined transport speed to travel said fixed minimum spacing;

counting pulses by said counter and delivering a timer signal when said number is reached; and actuating an annunciator in response to said timer signal.

9. A method as in claim 8, wherein said annunciator is a "wait" light, said sensing means detects said trailing edge, and said light is turned on at least when said first sheet trailing edge passes said feed point, and remains on until said first sheet trailing edge has travelled past said feed point by said fixed spacing.

10. A method as in claim 8, wherein said annunciator is a "ready" light, said sensing means detects said trailing edge, and said light is turned off at least when said first sheet trailing edge passes said feed point, and remains off until said first sheet trailing edge has travelled past said feed point by said fixed spacing.

11. A method as in claim 8, wherein said detecting step comprises detecting passage of said trailing edge.

12. A method as in claim 11, wherein said defining, controlling, setting and actuating steps are performed at least partly by a microprocessor.

13. The improvement as in claim 4, wherein said means for automatically setting said number comprises look-up table means addressable by said microprocessor for setting said number in response to said different transport speed.

14. A method as in claim 12, wherein said number is set under control of said microprocessor, addressing a look-up table in accordance with said defined transport speed.

* * * * *